United States Patent [19]

Taitel

[11] 3,930,620

[45] Jan. 6, 1976

[54] TURRET REWINDER

[75] Inventor: Charles M. Taitel, Parsippany, N.J.

[73] Assignee: Compensating Tension Controls Inc., Orange, N.J.

[22] Filed: Apr. 18, 1974

[21] Appl. No.: 461,935

[52] U.S. Cl. ..... 242/56 A
[51] Int. Cl.[2] ..... B65H 19/20
[58] Field of Search ..... 242/56 A, 64

[56] References Cited

UNITED STATES PATENTS

| | | | |
|---|---|---|---|
| 1,040,188 | 10/1912 | Gray | 242/56 A |
| 2,298,004 | 10/1942 | Fisher | 242/56 A |
| 3,411,732 | 11/1968 | Ebneter | 242/56 A |
| 3,552,670 | 1/1971 | Herman | 242/56 A |
| 3,733,035 | 5/1973 | Schott | 242/56 A |

*Primary Examiner*—Edward J. McCarthy
*Attorney, Agent, or Firm*—Gerald Durstewitz

[57] ABSTRACT

A five spindle turret rewinder wherein the turret is driven in steps so that each spindle successively dwells in each of five stations. A core is manually placed on the spindle at the first station. At the second station, heat liquified glue is applied to the core while the spindle is slowly rotated. At the third station, web leading to a filled roll at the fourth station is severed and applied to the glued core while heat liquified glue is applied to the back side of the web above the cut line. The web is wound onto the core at the fourth station. The spindles are driven rapidly at the third and fourth stations. The glued cut end of the web is pressed against the filled roll by a brush at the fourth station. The filled roll is automatically removed from the spindle at the fifth station.

14 Claims, 11 Drawing Figures

FIG. 5
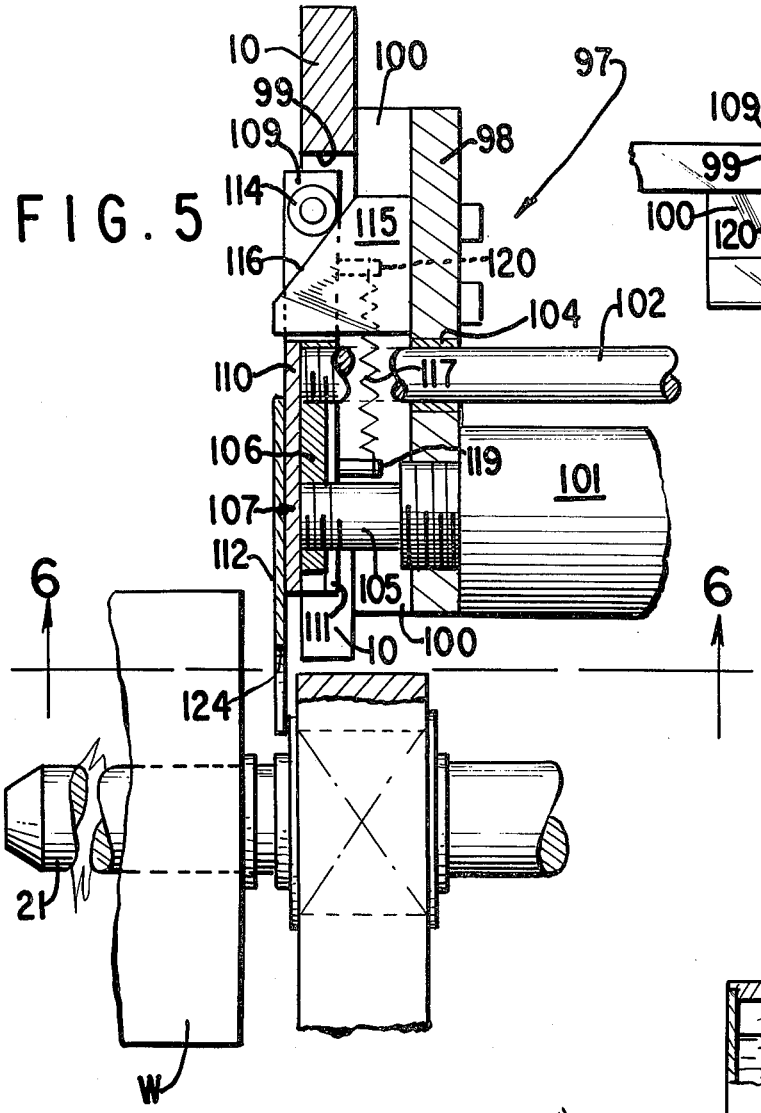
FIG. 6
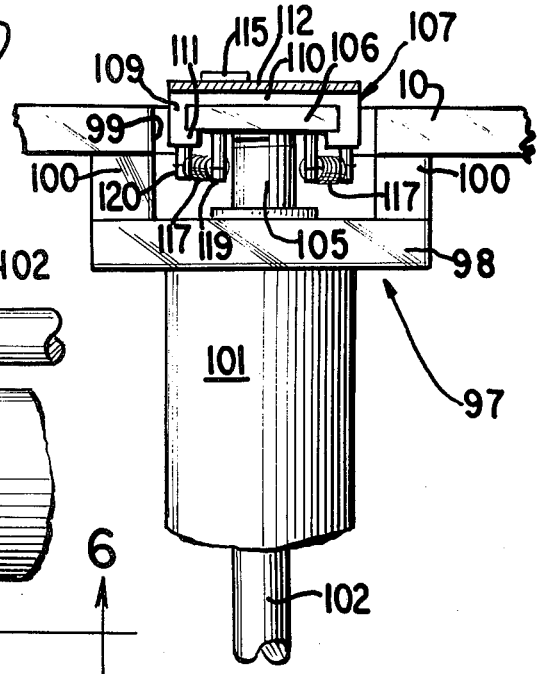
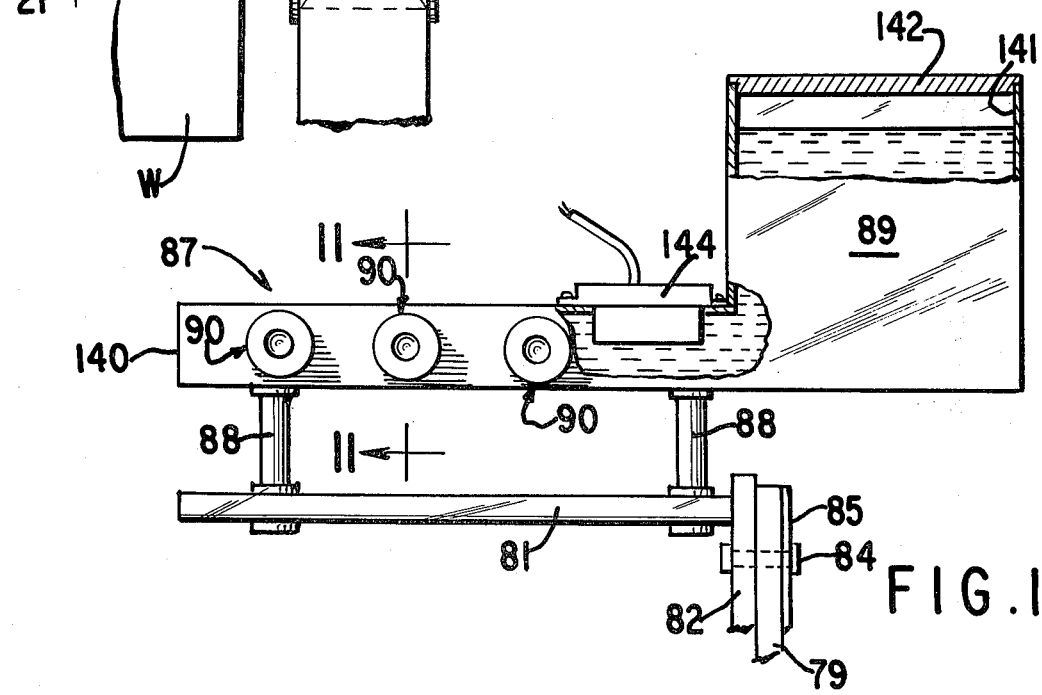
FIG. 10

TURRET REWINDER

BACKGROUND OF THE INVENTION

The present invention relates to machinery for rewinding web materials from a large diameter supply roll or processing machine to provide a plurality of smaller diameter rolls of web, and, more particularly to such machinery including a turret carrying a plurality of spindles on which web receiving roll cores are carried through a series of operations associated with the rewinding of the web.

OBJECTS OF THE INVENTION

It is an object of the present invention to provide improved web rewinding apparatus.

Another object is to provide a turret rewinding machine which allows for continuous web infeed.

Another object is to provide such a machine with a novel arrangement for securing the web end to roll cores.

Another object is to provide such a machine with novel means for driving spindles at different speeds in different turret positions.

Another object is to provide such a machine with novel means for cutting the web and applying the web end to a roll core.

Another object is to provide such a machine with novel means of securing the end of a roll of web.

Another object is to provide such a machine with novel means for removing web rolls from the machine.

Another object is to provide novel means for applying adhesives.

SUMMARY OF THE INVENTION

The foregoing objects are accomplished by providing web rewinding apparatus comprising in combination a frame, a turret mounted for rotation with respect to the frame, a plurality of spindles carried by the turret for receiving web roll cores, the spindles being equally spaced around the edge of the turret, at least four equally spaced stations on the frame adjacent the periphery of the turret, the first station being for placement of web roll cores on the spindles, means for rotating the turret in steps to sequentially position each of the spindles at each of the stations, means at the second station for applying glue on the cores, means for feeding web from a supply to the core at the fourth station, and means at said third station for cutting the web extending to the fourth station and applying the end of the web to the core at the third station.

BRIEF DESCRIPTION OF THE DRAWINGS

A preferred embodiment of the invention has been chosen for purposes of illustration and description and is shown in the accompanying drawings forming a part of the specification, wherein:

FIG. 5 is a sectional view taken along the line 5—5 on FIG. 4 showing the web roll ejector mechanism;

FIG. 6 is a sectional view taken along line 6—6 on FIG. 5;

FIG. 10 is a view taken along line 10—10 on FIG. 1 showing the details of the glue applicator mounted on the lever 79.

DESCRIPTION OF THE PREFERRED EMBODIMENT

Figure 1:
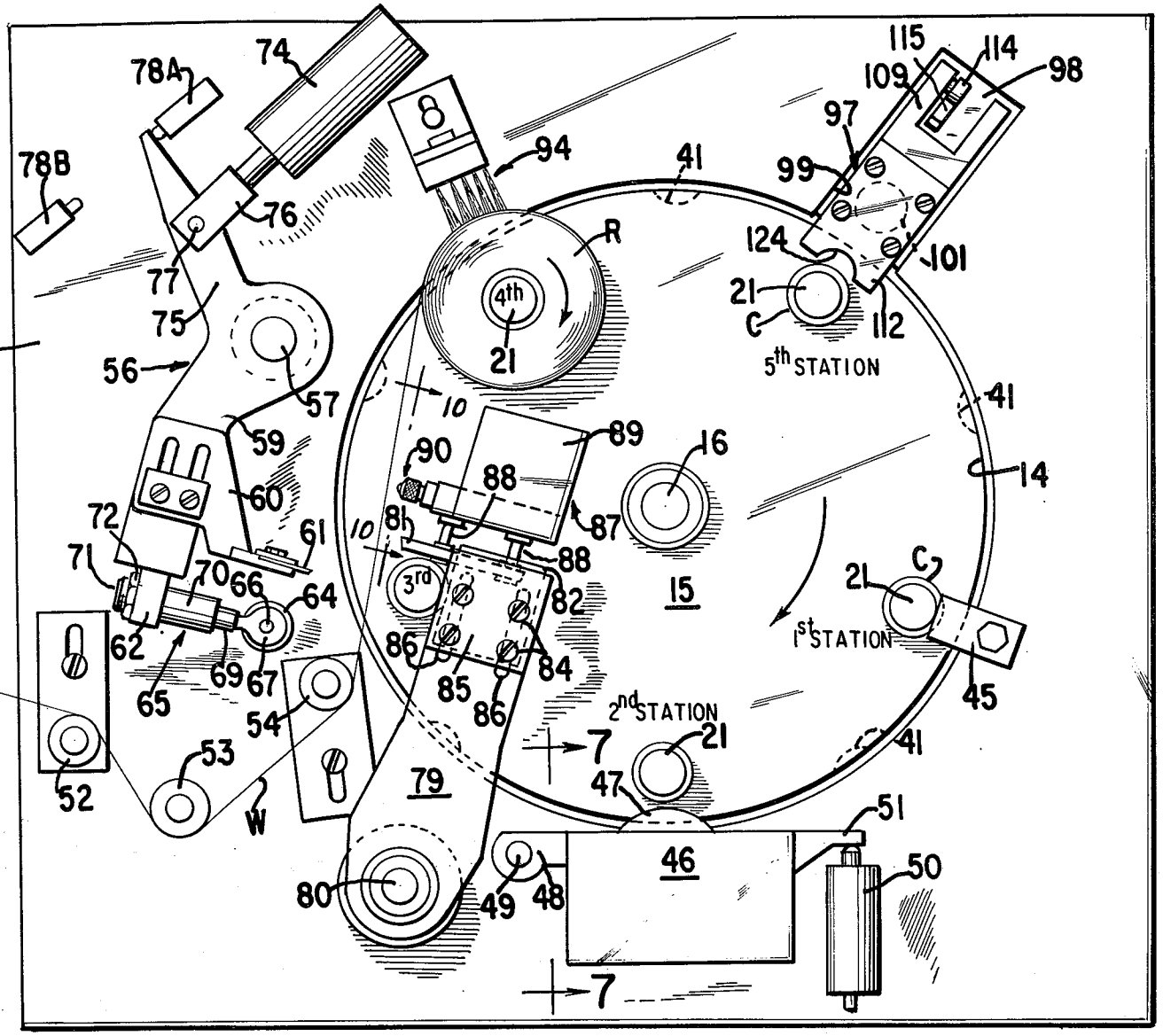
FIG. 1 is an elevational front view of a machine according to the present invention.
Figure 2:
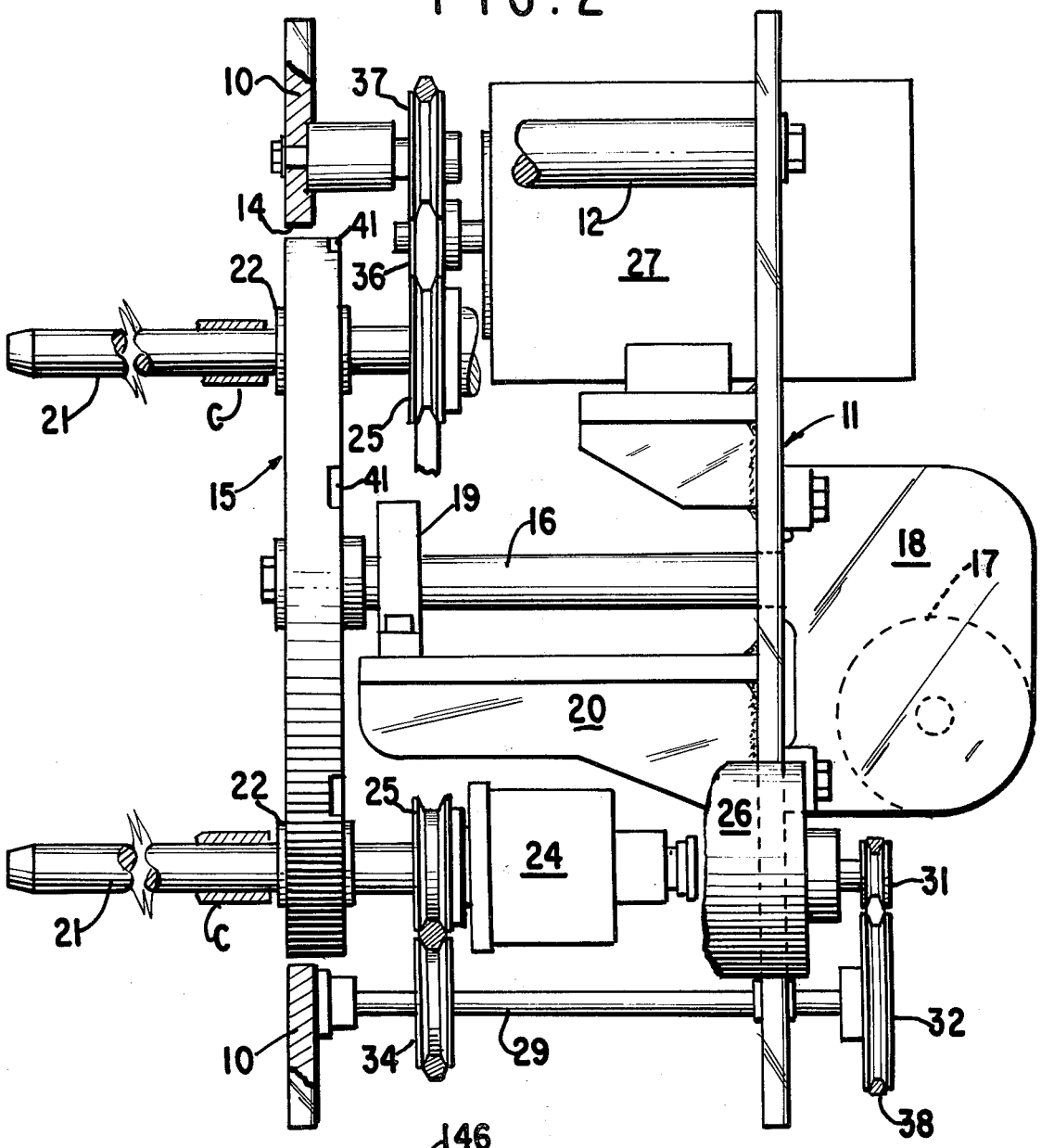
FIG. 2 is an elevational side view of a portion of of the machine shown in FIG. 1.

With reference to the drawings in detail there is shown a web rewinding apparatus according to the present invention which includes a front frame plate 10 and a rear frame plate 11 connected thereto by a plurality of spacer rods 12. The front frame plate 10 is provided with a large opening 14 in which there is positioned a round turret plate 15. The turret plate 15 is mounted on a shaft 16 which is driven by a motor 17 through a gear box 18 both of which are mounted on the rear frame plate 11. The shaft 16 is supported by a bearing 19 mounted on a plate 20 which extends from the rear frame plate 11 toward the front frame plate 10.

Five spindles 21 are journalled about the outer periphery of the turret plate 15 in bearings 22. Constant torque clutches 24 of the type shown in copending U.S. Pat. application Ser. No. 442,175 are mounted on the inner ends of the spindles between the frame plates 10 and 11.

The clutches 24 are driven by means of pulleys 25 mounted thereon and operate to transmit a preset constant torque to the spindles. Two motors 26 and 27 supply power to the pulleys 25, each at different times. The motor 26 drives a shaft 29 through a belt 30 connecting a pulley 31 on the motor shaft to a pulley 32 on the shaft 29. The shaft 29 is journalled in the frame plates 10 and 11 and carries a drive wheel 34 for engaging the pulley 25 of the clutches 24.

Figure 3:
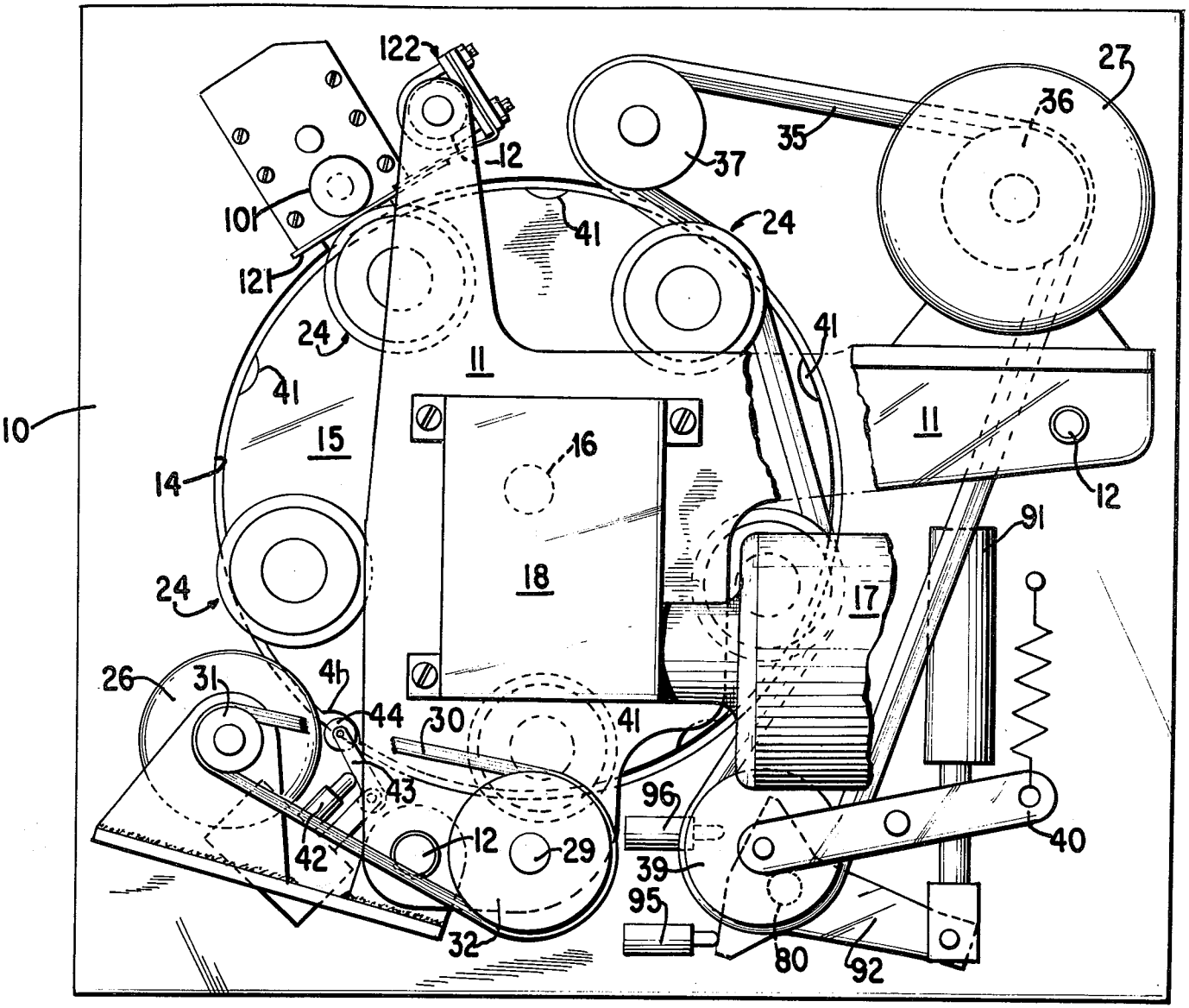
FIG. 3 is an elevational rear view of the machine shown in FIG. 1.

The motor 27 (as shown in FIG. 3) drives a double V-belt 35 one side of which engages a pulley 36 on the motor shaft, an idler pulley 37 journalled in the frame plate 10, and a second idler pulley 39 mounted on a spring biased lever 40. The other side of the belt engages the pulleys 25 of two of the constant torque clutches 24 mounted on the spindles 21.

The rear surface of the edge of turret plate 15 is formed with semicircular depressions 41 positioned midway between the spindles 21. A limit switch 42 is mounted on the rear surface of the frame plate 10 and is provided with an operating lever 43 having roller 44 for engaging the periphery of the turret plate. The limit switch 42 is connected to stop the motor 27 each time the turret plate is driven to a position aligning a depression 41 with the roller 44. The motor 27 remains de-energized for a preset cycle (for example, 10 seconds) and is restarted as described hereinafter. The turret 15 is thus moved in steps, each spindle being sequentially moved to each of five stations and remaining in each station for the preset time cycle.

Referring to FIG. 1, at the first station a core stop plate 45 is mounted to the front face of the frame plate 10. A core C is manually placed on the spindle at this station and the stop plate 45 spaces the end of the core from the face of the turret plate 15 to facilitate removal at the fifth station.

A glue applicator 46 is positioned at the second station to apply heat liquified pressure sensitive glue on the core C. The spindle at the second station is rotated slowly (e.g., at 120 rpm) by engagement of its clutch pulley 25 with the drive wheel 34 driven by the motor 26. The glue applicator, which will be described in detail hereinafter, transfers liquid glue to the cores by means of metal discs 47 which extend into a reservoir of melted glue. The applicator 46 is supported by an arm 48 which is pivoted on a pin 49 extending from the plate 10. The applicator is lifted to place the discs 47 in contact with the core by means of a pneumatic actuator 50 acting against an arm 51 extending from the applicator.

As each spindle is moved into the second station, the cylinder 50 is briefly operated to lift the applicator and bring the discs 47 into contact with the core for a short interval (for example, 2 seconds). Upon contact with the rotating core, the discs 47 are rotated and transfer glue to the core, each one depositing a line of glue around the circumference of the core. For the rest of the cycle, the glue cools and hardens as the core is rotated slowly. By the end of the cycle, the glue has hardened sufficiently to prevent it from being thrown off by the rapid rotation that the cores experience at the third station.

As each spindle moves from the second station to the third, the pulley 25 of its clutch 24 engages the belt 35 to cause the spindles to rotate rapidly (e.g., at 1,500 rpm) at both the third and fourth stations.

At the end of each cycle, the web W is applied to the core at the third station, as described in detail hereinafter. The core is then moved to the fourth station where the winding of the web onto the core is completed. The web W is fed to the core from a supply roll (not shown) over three idler rollers 52–54.

A web cutting and applying lever 56 is journalled on a shaft 57 mounted to the frame plate 10 between the third and fourth station. The lower arm 59 of the lever carries an adjustably positioned bracket 60 on which is mounted a knife blade 61 for severing the web W. At the extreme end of the arm 59 is a flange 62 to which a roller 64 is mounted by means of a pair of spring loaded telescoping assemblies 65. The roller is journalled on a shaft 66. Each end of the shaft 66 is mounted in an annular fitting 67 mounted on the inner member 69 of the assembly 65. The outer member 70 of each of the assemblies 65 has a threaded portion 71 of reduced diameter which extends through a hole in the flange and is held thereto by a nut 72.

A pneumatic cylinder 74 is mounted to the frame plate 10 and connected to the upper arm 75 of the lever 56. A U-shaped connector 76 is fastened to the shaft of the cylinder and a pin 77 pivotally attaches the connector to the arm 75. A pair of electrical switches 78A and 78B are mounted on frame plate 10 on either side of the arm 75 to be operated by the tip of the arm.

A second arm 79 is mounted on the end of a shaft 80 which extends through and is journalled in the front frame plate 10. The shaft 80 is of sufficient length to allow the arm 79 to rotate past the end of the spindles. Mounted on the end of the arm 79 is a knife back-up bar 81 which extends inwardly toward the turret plate 15. The bar 81 is welded to a block 82 which is secured to the arm 79 by four bolts 84 which extend through a back-up plate 85 and through a pair of slots 86 into the block 82.

A second glue applicator 87 is mounted to the plate 81 by means of four bolt assemblies 88. The glue applicator 87 includes a reservoir 89 which feeds glue by gravity to a plurality of ball applicator tips 90 for applying glue to the web when it is cut. The applicator is described in detail hereinafter.

The arm 79 is illustrated in its operated position to more clearly show its operation. The normal position of the arm is displaced about 30° clockwise from the position shown. As shown in FIG. 3, the shaft 80 is rotated by a pneumatic cylinder 91 through an arm 92 to move the arm into its operated position. A pair of pneumatic switches 95 and 96 are mounted on the back of the plate 10 to be operated by the arm 92.

About one second before the end of each cycle, a counter (not shown) which is driven by the motion of the web operates a solenoid valve to energize the cylinder 91 and move the arm 79 counterclockwise into the position shown in FIG. 1. The arm 92 (FIG. 3) operates a pneumatic switch 95 which admits high pressure air to the cylinder 74. The shaft of the cylinder 74 extends and rotates the lever 56 counterclockwise bringing the knife blade 61 against the back-up bar 81 cutting the web W. As the knife 61 is cutting the web, the roller 64 presses the web against the glue coated core mounted on the spindle so that the web immediately begins to wind onto the core now at station three. Also, as the knife blade 61 cuts the web, it deflects the web moving it into contact with the applicator tips 90 and glue is applied onto the underside of the web above the cut line. The glued end of the web is pressed against the roll R at the fourth position by a brush 94 mounted on the frame plate 10.

As the knife blade 61 cuts the web, the tip of the lever arm 75 operates the pneumatic switch 78B which energizes the cylinder 91 to retract its shaft rotating the arm 79 clockwise and also energizes the cylinder 74 to retract its shaft rotating the lever arm 56 clockwise. When both arms 79 and 56 return to their original position, they operate the pneumatic switches 96 and 78A respectively. These switches are serially connected to a pressure operated electrical switch which actuates the starting circuit of the motor 17. The motor 17 then drives the turret plate 15 to advance all of the spindles one position.

Figure 4:
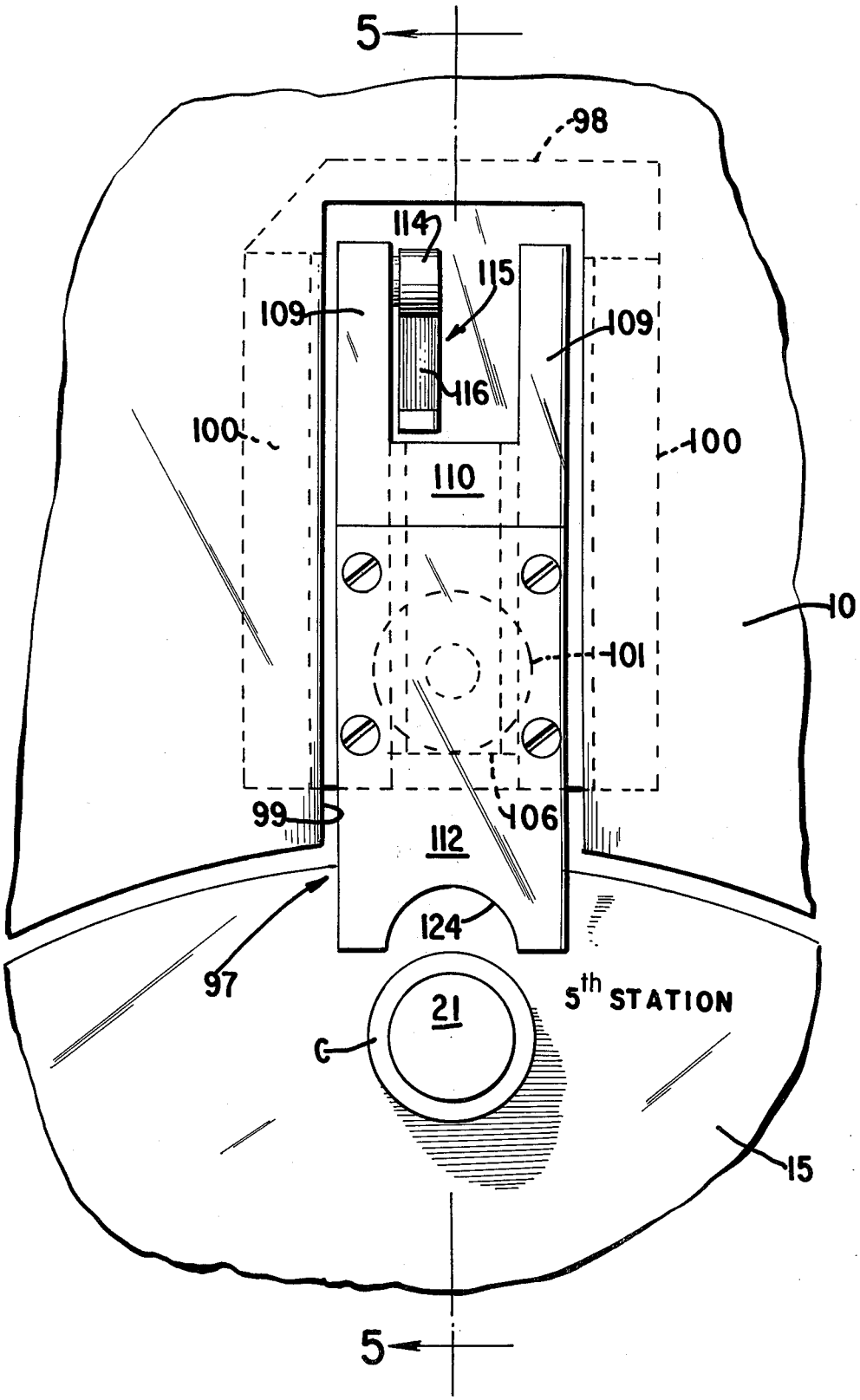
FIG. 4 is an enlarged view of a section of FIG. 1 showing the ejector mechanism.

At the fifth position the rolls of web are automatically removed from the spindles by a stripper mechanism 97. As shown in FIGS. 4, 5, and 6, the stripper mechanism 97 includes a plate 98 mounted to the rear face of the frame plate 10 behind a cutout 99 in the plate 10 at the edge of the opening. The plate 98 is parallel to the plate 10 and is spaced therefrom by a pair of rectangular bars 100. A pneumatic actuator 101 is mounted to the plate 98 and an antirotation rod 102 extends through a bushing 104 mounted in the plate 98. The piston shaft 105 of the actuator 101 and the rod 102 are screwed into a base slide plate 106. An upper slide member 107 is telescopingly mounted on the base slide plate 106. The member 107 has two side sections 109 which engage the sides of the plate 106, a plate section 110 interconnecting the side sections and overlying the outer face of the plate 106, a pair of lips 111 which extend inwardly from the side sections 109 in engagement with the inner face of the plate 106 to enclose the plate 106 within the member 107. A stripper plate 112 is mounted to the outer face of the member 107 to extend over the turret plate and engage the core of the roll of web to effect removal of the roll. On the other end of the member 107, the plate section 110 is cut away and a roller 114 is mounted to the inside surface of one of the side sections 109. A cam member 115 is mounted to the plate 98 and is formed with an inclined camming surface 116 for coaction with the roller 114. The upper slide member 107 is biased toward the turret plate by a pair of springs 117. The springs 117 are stretched between pins 119 extending from the plate 106 and pins 120 extending from the side sections 109. The action of the springs is opposed by the engagement of the roller 114 against the surface 116.

When a spindle is moved from the fourth and the fifth stations, its clutch pulley 25 is moved out of contact with the belt 35 and into contact with a flat spring brake member 121 which is attached to a spacer rod 12 by means of a clamp 122. The frictional engagement of the pulley 25 with the brake member 121 brings the rotating pulley to a stop.

When the actuator 101 is energized to extend the rod 105, the plate 106 and the member 107 are moved, as a unit, away from the plate 98 allowing the roller 114 to ride up the surface 116 of the cam 115 as the springs 117 slide the member 107 along the plate 106 toward the turret plate. The free end of the stripper plate 112, which is formed with an arcuate recess 124, moves toward the spindle in the fifth position, engages the end of the core of the web roll on the spindle, and strips the web roll from the spindle.

Figure 7:
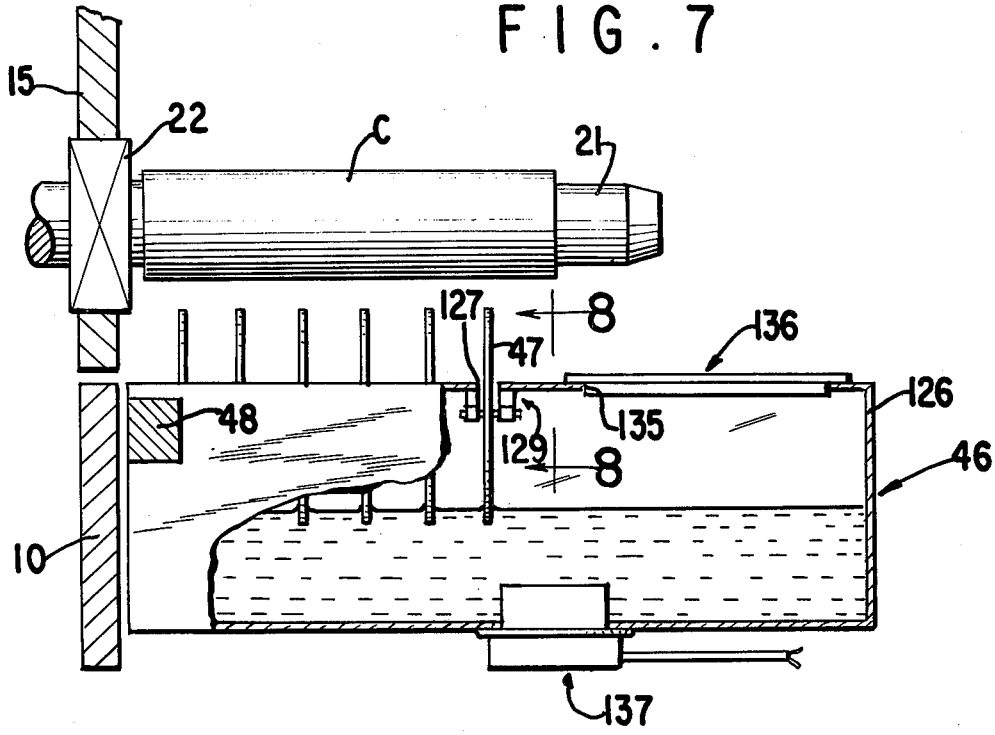
FIG. 7 is a view, partly in section, taken along line 7—7 on FIG. 1 showing the details of glue application at the second station.

The glue applicator 46, as shown in FIGS. 1 and 7, includes a rectangular glue container 126 formed with six parallel slots 127 in the top wall thereof. Each of the metal discs 47 is mounted in one of the slots 127 on a bifurcated spring 129.

Figure 8:
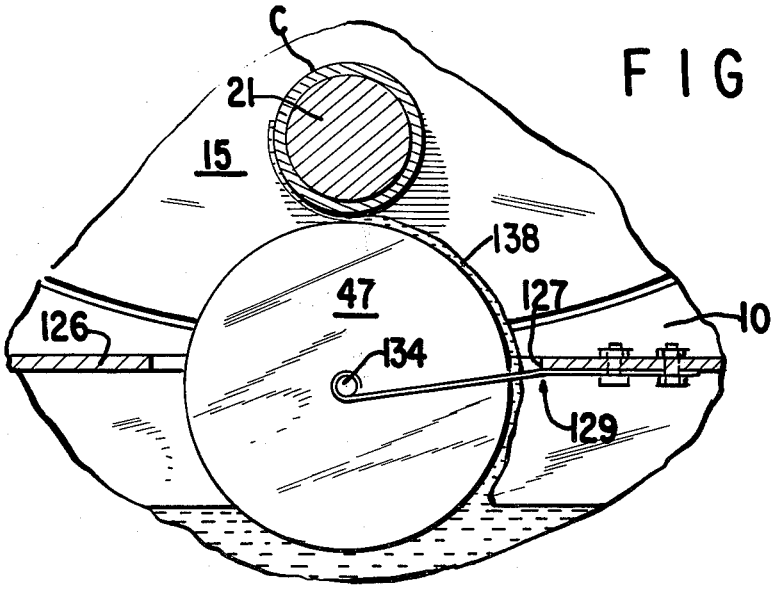
FIG. 8 is a view taken along line 8—8 on FIG. 7.
Figure 9:
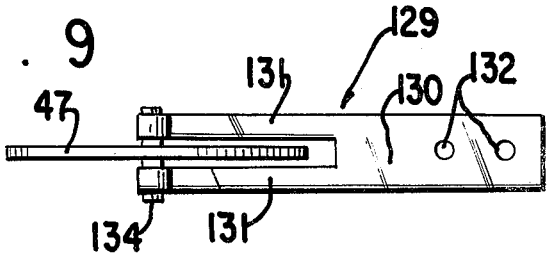
FIG. 9 is a plan view of a sub-assembly of the applicator shown in FIG. 7.

As shown in FIG. 9, the spring 129 is formed with a base section 130 and two arms 131. The base section 130 is provided with two mounting holes 132. The ends of the arms 131 are bent around a shaft 134 on which the disc 47 is mounted. As shown in FIG. 8, the spring 129 is bolted to the inside surface of the top wall of the container 126.

The container 126 is filled with heat liquified pressure sensitive glue through an opening 135 in the top wall. A cover 136 is normally positioned in the opening. The glue level is maintained so that the discs 47 extend into the glue and the glue is maintained at a fixed predetermined temperature by means of a thermostatically controlled electrical heater element 137.

When the applicator 46 is lifted by the actuator 50, the discs 47 engage the core and are driven by the rotating spindle. As each disc turns, a bead of glue 138 adheres to its outer edge surface. The size of the bead of glue is controlled by speed at which the disc is turned and by the viscosity of the glue, which varies with the temperature to which the glue is heated. The amount of glue deposited by each of the discs depends upon the size of the glue bead carried by the disc and by the number of times the disc is revolved while in contact with the core.

The glue applicator 87, as shown in FIGS. 1 and 10, includes a flat rectangular chamber 140 upon which the reservoir 89 is mounted. The nozzles 90 are threaded into the side wall of the chamber 140 and the bolt assemblies 88 are secured to the lower wall of the chamber.

Heat liquified glue is poured into the reservoir 89 through its upper open end 141 which is normally closed by a cover 142. The chamber 140 and the reservoir 89 are filled with glue providing a hydraulic head to place the glue at the nozzles under pressure. A thermostatically controlled heating element 144 is mounted on the top wall of the chamber 140 to maintain the glue in liquid state.

Figure 11:
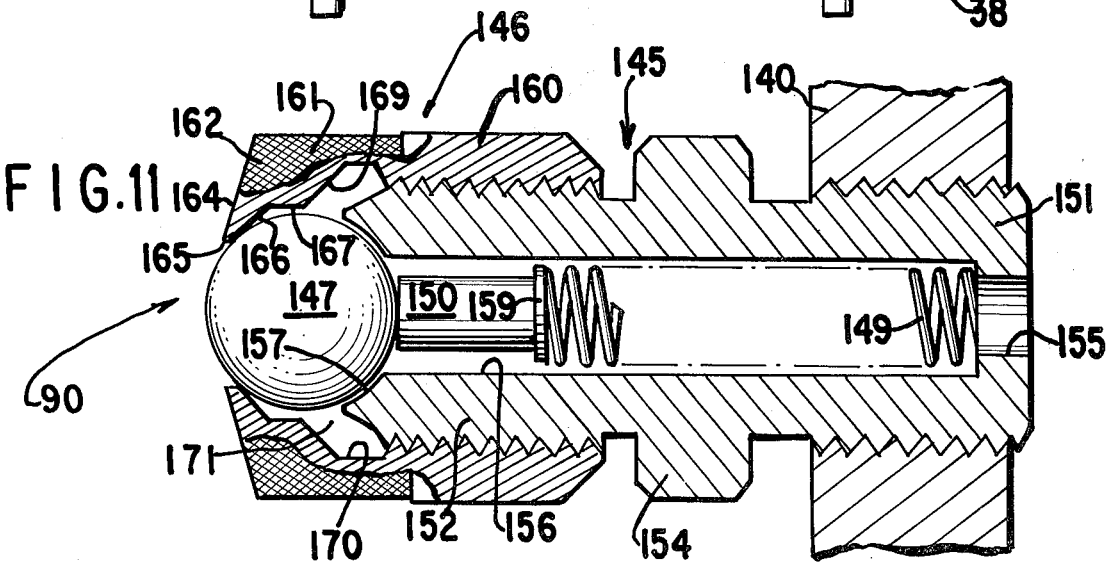
FIG. 11 is a longitudinal sectional view of a nozzle assembly of the glue applicator shown in FIG. 10.

As shown in FIG. 11, the nozzles 90 include a body 145, an end cap 146, an applicator ball 147, a spring 149, and a pusher member 150. The body 145 has an end section 151 threaded into the wall of the chamber 140, a second end section 152 upon which the end cap 146 is threaded, and a central section 154 formed to accept a wrench. The body 145 is provided with an inlet port 155 and an axial bore 156 of larger diameter than the port. The bore 156 extends from the port 155 to the other end of the body. The second end section 152 is formed with a spherical surface 157.

The spring 149 is positioned in the bore 156 and the pusher member 150 is inserted into the spring 149. The pusher is provided with a flange 159 which engages the end of the spring.

The cap 146 is formed with a threaded annular base portion 160 engaging the end 152 of the body 145, and a head portion 161 having a knurled outer surface 162. The head portion 161 has an end wall 164 provided with a central opening 165. The interior surface of the head portion 161 is formed with a stepped bore extending from the opening 165 to the base portion 160. The bore is defined by a conical surface 166 intersecting the opening 165, a cylindrical surface 167, a second conical surface 169, and a second cylindrical surface 170. A chamber 171 is formed between the stepped bore, the ball 147, and the end of the body section 170.

The applicator ball 147 is held against the conical wall 166 by the action of the spring 149 upon the pusher 150. Liquified glue flows, under the pressure head developed by the height of the liquid glue in the reservoir 89, through the port 155 and the bore 156, and through the space between the ball 147 and the surface 157 into the chamber 171.

As the roller 64 and the knife 61 engage the web at the third station, the moving web is deflected and is pressed against the exposed surface of the ball 147. The ball 147 is rotated by its contact with the moving web and the glue in the chamber 171 is picked up by the surface of the rotating ball and transferred to the web. At the same time, the ball 147 is moved rearwardly against the action of the spring 149 to seat against the spherical surface 157 and seal off the flow of glue into the chamber 171. The movement of the ball 147 against the surface 157 prevents the transfer of excessive glue onto the web by preventing glue under pressure from flowing past the ball 147 (and thus squirting onto the web) and by preventing additional glue from flowing into the chamber 171.

It will be seen from the foregoing description that the apparatus disclosed herein accomplishes all of the aforestated objects.

As various changes may be made in the form, construction, arrangement and use of the apparatus shown herein without departing from the spirit and scope of the invention, it is to be understood that all matter herein is to be interpreted as illustrative and not in any limiting sense.

We claim:

1. Web rewinding apparatus comprising in combination a frame, a turret mounted for rotation with respect to said frame, a plurality of spindles carried by the turret for receiving web roll cores, said spindles being equally spaced around the edge of the turret, at least four equally spaced stations on said frame adjacent the periphery of said turret, the first station being for placement of web roll cores on the spindles, means for rotating the spindles, means for rotating said turret in steps to sequentially position each of said spindles at each of said stations, means at said second station for applying glue on the cores, means for feeding web from a supply to the core at the fourth station, and means at said third station for cutting the web extending to the fourth station and applying the end of the web extending from said supply to the core at the third station, said means for rotating said spindles including a plurality of rotary elements carried by said turret, each operatively connected to one of said spindles, a double-faced endless drive member, means for driving said endless drive member including two frame mounted rotary elements positioned at widely spaced points about the periphery of said turret, one face of said endless drive member being in driving contact with said two frame mounted rotary elements and the opposite surface being in contact with said spindle rotary elements positioned between said frame mounted rotary elements.

2. Apparatus according to claim 1 wherein said means for rotating said spindles is arranged to drive spindles in said third and fourth positions, and wherein means are provided for driving the spindle at said second station at slow speed to prevent the glue applied to the core of the spindle at the second station from being thrown off.

3. Apparatus according to claim 2, wherein said means for applying glue at said second station includes a container, a quantity of heat liquifiable glue in said container, means for maintaining the glue at a predetermined temperature, a glue applicator rotatably mounted to said container so as to extend into the glue and protrude from said container, and means for moving said container toward said spindle in said second position to bring the glue applicator into contact with the core on the spindle in said second position, whereby rotation of the spindle rotates the glue applicator to carry glue from said container and deposit the glue on the core.

4. Apparatus according to claim 3, including a plurality of glue applicator discs arranged in a row parallel to said spindles, each of said discs being rotatably mounted on a spring member secured to said container.

5. Apparatus according to claim 4, wherein said glue varies in viscosity with temperature whereby the amount of glue deposited can be controlled by varying the relationship between the temperature of the glue, the speed of spindle rotation and the period during which the spindle and the discs are in contact.

6. Web rewinding apparatus comprising in combination a frame, a turret mounted for rotation with respect to said frame, a plurality of spindles carried by the turret for receiving web roll cores, said spindles being equally spaced around the edge of the turret, at least four equally spaced stations on said frame adjacent the periphery of said turret, the first station being for placement of web roll cores on the spindles, means for rotating the spindles, means for rotating said turret in steps to sequentially position each of said spindles at each of said stations, means at said second station for applying glue on the cores, means for feeding web from a supply to the core at the fourth station, and means at said third station for cutting the web extending to the fourth station and applying the end of the web extending from said supply to the core at the third station, said means for cutting the web and applying the end of the web to the core including a member mounted on said frame to be moveable toward the core at said third station, a roller parallel to the core carried by said member and positioned to press the web against the core in the third position, a knife blade carried by said member to engage and cut the web between the third and fourth positions as said roller presses the roller against the core, and means for moving said member toward the core at said third station.

7. Apparatus according to claim 6, including a second arm pivoted to said frame, and a back-up bar carried by said second arm to be positioned in alignment with said knife blade on the opposite side of said web.

8. Apparatus according to claim 7, including a second glue applying means mounted on said second arm to contact the web between the knife blade and the fourth position when said arms are pivoted to cut the web.

9. Apparatus according to claim 8, wherein said second glue applying means includes a glue receptacle, a quantity of glue in said receptacle, and a dispensing nozzle facing the web extending to said fourth station, said dispensing nozzle including a body extending from said receptacle formed with a bore in communication with said glue in said receptacle, a head member mounted on said body having an aperture therein, means providing a valve seat at said aperture, said head member being formed to provide a chamber at the end of said body in communication with said aperture and said bore, a valve member within said chamber for sealing said aperture, said valve member being constructed to extend through said aperture to be contacted by the web and moved away from the aperture to allow glue to flow onto the web.

10. Apparatus according to claim 9, including means providing a valve seat at the end of said body for cooperating with said valve member to prevent glue flow into said chamber when said valve member is moved away from the aperture whereby the glue dispensed is limited.

11. Apparatus according to claim 10, wherein said valve member is a ball.

12. Apparatus according to claim 11, including means for urging the ball toward the aperture.

13. Web rewinding apparatus comprising in combination a frame, a turret mounted for rotation with respect to said frame, a plurality of spindles carried by the turret for receiving web roll cores, said spindles being equally spaced around the edge of the turret, at least five equally spaced stations on said frame adjacent the periphery of said turret, the first station being for placement of web roll cores on the spindles, means for rotating the spindles, means for rotating said turret in steps to sequentially position each of said spindles at each of said stations, means at said second station for applying glue on the cores, means for feeding web from a supply to the core at the fourth station, means at said third station for cutting the web extending to the fourth station and applying the end of the web to the core at the third station, and means at the fifth station for engaging the core on the spindle positioned thereat and sliding said core off said spindle, said core removing means including an actuator having a rod movable at right angles to said frame, a first slide member parallel to said frame mounted on said rod to move therewith, a second slide member slidably mounted on said first slide member, means for moving said second slide member toward said spindle in said fifth position as said first slide member moves away from said frame and for retracting said second member when said first member is moved toward said frame.

14. Apparatus according to claim 6, wherein said member is an arm pivoted on said frame.

* * * * *